US006158950A

United States Patent [19]

Wilt et al.

[11] Patent Number: 6,158,950

[45] Date of Patent: Dec. 12, 2000

[54] EXCAVATOR COUPLING

[75] Inventors: Albert T. Wilt; Gary Ingram, both of Ooltewah, Tenn.

[73] Assignee: C & P Enterprises, Inc., Ooltewah, Tenn.

[21] Appl. No.: 09/260,977

[22] Filed: Mar. 2, 1999

[51] Int. Cl.[7] ..... E02F 3/32

[52] U.S. Cl. ..... 414/723; 37/468

[58] Field of Search ..... 414/723; 37/468; 403/321, 322.1, 322.3, 322.4, 325

[56] References Cited

U.S. PATENT DOCUMENTS 4,436,477 3/1984 Lenertz et al. ..... 414/723
5,549,440 8/1996 Cholakon et al. ..... 414/723

*Primary Examiner*—Donald W. Underwood
*Attorney, Agent, or Firm*—MIller & Martin LLP; Alan Ruderman

[57] ABSTRACT

A coupler attached to the articulating arm linkage of an excavator may be coupled to a bucket or other work implement, the coupler having a rotator carried between and rotatable relative to a pair of body parts. The rotator has an elongated channel for receiving a pin of the work implement and carries a crank which may be manually turned or moved by a hydraulic cylinder to drive the rotator. In one position, the channel is open for permitting entry and removal of the pin and in other positions is closed to lock the pin from exiting. The coupler includes another pin receiving slot so that a second pin of the work implement may be received. The slot and the channel of the rotator in the open position are inclined relative to one another. The crank in one embodiment has a number of projections for cooperating with elements of a hand operated lever to drive the rotator. When the hand operated lever is not in use, it may be stored conveniently within the coupler to serve as a locking device. In another embodiment the crank is connected to the output rod of the hydraulic cylinder.

17 Claims, 8 Drawing Sheets

EXCAVATOR COUPLING

BACKGROUND OF THE INVENTION

This invention relates to a coupling for connecting the articulating links of an excavator boom to the excavator bucket.

In the earthmoving art, excavators or backhoes are used extensively with various attachments or tools connected to the articulating arm elements. A bucket, shovel or other tool must be readily connected with the ability to pivot relative to the arm and yet be readily removable therefrom for attachment of another tool or for travel. Downtime for such changing of tools must be relatively low. Thus, the art has developed a number of coupling devices which are carried by the articulating arm members and manipulated to engage the bucket or other tool which is then locked or secured to the arm for use.

Although the prior art has dealt extensively with this matter, many of the solutions are believed to be unnecessarily complicated and expensive. Most of these constructions utilize hydraulic cylinder apparatus for locking and securing the bucket or other tool to the excavator. For example, the following U.S. Patents all disclose hydraulic drives: Essex, et al., U.S. Pat. No. 4,881,867 moves a slide to capture and lock a pin of the bucket; Bahemi, U.S. Pat. No. 5,082,389 rotates a latch to lock a bucket pin; Weyer, U.S. Pat. No. 5,145,313 moves forks of a clevis to capture and lock a bucket pin; Brown, U.S. Pat. No. 5,400,531 moves a pin carrying linkage; Cholakon, et al., U.S. Pat. No. 5,549,440 rotates a C-shaped locking tube relative to fixed C-shaped member; and Horton, U.S. Pat. No. 5,727,342 moves a latchpin.

Although such hydraulically driven structures are generally effective, most of them are complicated and some of them are relatively difficult to use for various reasons. In some cases, such as in U.S. Pat. No. 5,549,440 it is difficult for the operator to view the positioning of the coupling relative to a pin receiving aperture.

Other couplers in the prior art which although not hydraulically operated, are complicated mechanical devices such as Arnold, U.S. Pat. No. 5,332,353; Gebauer, et al., U.S. Pat. No. 5,423,625 and Horton, et al., U.S. Pat. No. 5,634,735. Again, the complexities of these devices result in relatively expensive couplers.

SUMMARY OF THE INVENTION

Consequently, it is a primary object of the present invention to provide a coupling for connecting a bucket or other implement to an excavator or the like which is simple, inexpensive and safe.

It is another object of the present invention to provide coupling apparatus for connecting a working implement to an excavator or the like which is manually operable using a hand tool storable within the coupling apparatus.

It is a further object of the present invention to provide coupling apparatus for connecting a bucket or other implement to an excavator backhoe or the like which includes a manually rotatable member for permitting coupling and uncoupling to occur and a tool for rotating the member, the tool being stored within the coupling apparatus itself when not in use.

It is a still further object of the invention to provide a hydraulically assisted coupler which is uncomplicated and which is easy to use.

Accordingly, the present invention provides a coupler which may be fastened to the articulating arm linkage of an excavator or the like and may be coupled or connected to a bucket or other work implement in a simple manner manually or by power means, the coupler comprising a rotator carried between and rotatable relative to a pair of body members, the rotator having a crank which may be manually or hydraulically turned to drive the rotator, the rotator having a mouth which in one position is open to permit entry for a first mounting pin on the work implement and in another position is closed to lock the pin from exiting therefrom and the coupler having an open slot for receiving a second pin, the axis of the mouth of the rotator in the open position being inclined relative to the axis of the slot.

The crank comprises a member which has elements that cooperate with elements of a hand tool manually operable by an operator. In this form of the invention, the hand tool is stored between the body members of the coupling when not in use and locks the crank and is readily available when needed. In another embodiment the crank is connected to a power drive member such as a hydraulic cylinder.

Additionally, the invention provides an excavator machine having the coupler carried thereby for rapidly and readily connecting the excavating machine to a bucket or the like.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENTS

Figure 1:
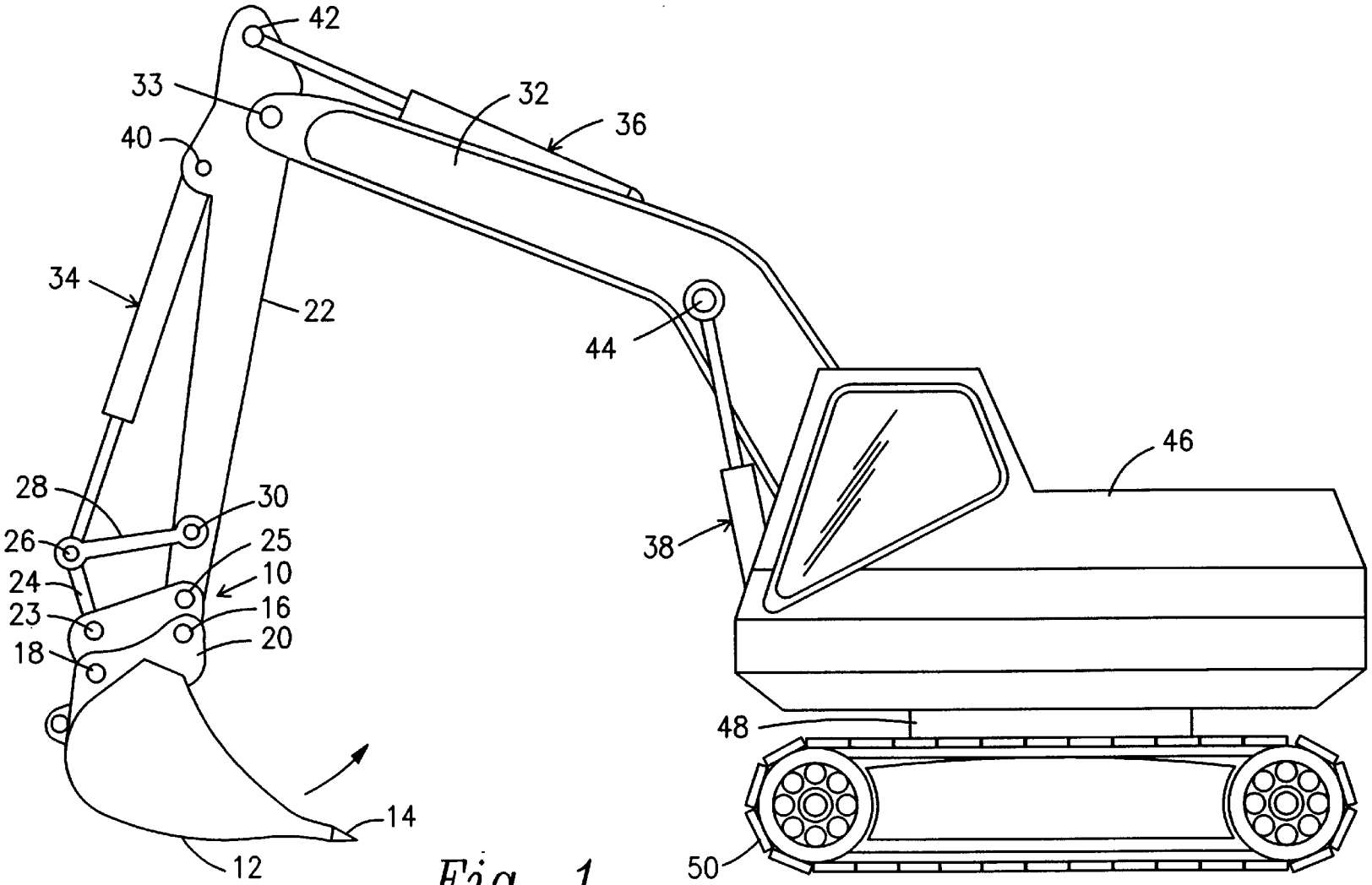
FIG. 1 is a side elevation of view of an excavator apparatus having a boom including an articulating arm in which a bucket is attached by means of a coupler constructed in accordance with the principles of the present invention.

Referring now to the drawings, a coupler 10 constructed in accordance with the present invention is utilized in conjunction with an excavator bucket 12 or other excavator implements having teeth-like prongs 14, only one of which is illustrated. The bucket 12 is connected by journal pins 16, 18 extending through bucket mounting plates 20 (only one of which is illustrated) which may be integral with the bucket and connected by the coupling 10 to an articulating arm 22 intermediate the plates and one end of a pair of articulating links 24 also disposed intermediate to plates 20, the coupler 10 being secured to pins 23, 25 respectively carried by the articulating links 24 and articulating arm 22. The articulating links 24 are, in turn, connected by a journal pin to one end of a second pair of respective links 28 having second ends connected to the articulating arm 22 by a journal pin 30 spaced above the bucket 12. The articulating arm 22 comprises a portion of the boom assembly of the excavator, the assembly also including a lift arm 32 to which the articulating arm is pivotally journaled and pinned at 33, and three hydraulic piston-cylinder assemblies 34, 36 and 38. The rod end of the assembly 34 is pivotally journaled on the pin 26 intermediate the links 28 and has the cylinder end pivotally connected to the articulating arm 22 by a journal pin 40. The assembly 36 has its rod end pivotally journaled to the articulating arm 22 and its cylinder end journaled to the lift arm 32, while the assembly 38 has its rod end pivotally journaled to the lift arm 32 by a pivot pin 44 and its cylinder end journaled to the cab 46 of the excavator vehicle which may rotate about a base 48 relative to tractor tracks 50. The excavator, of course, may be any type of such earthmoving equipment including a backhoe and the like.

Figure 2:
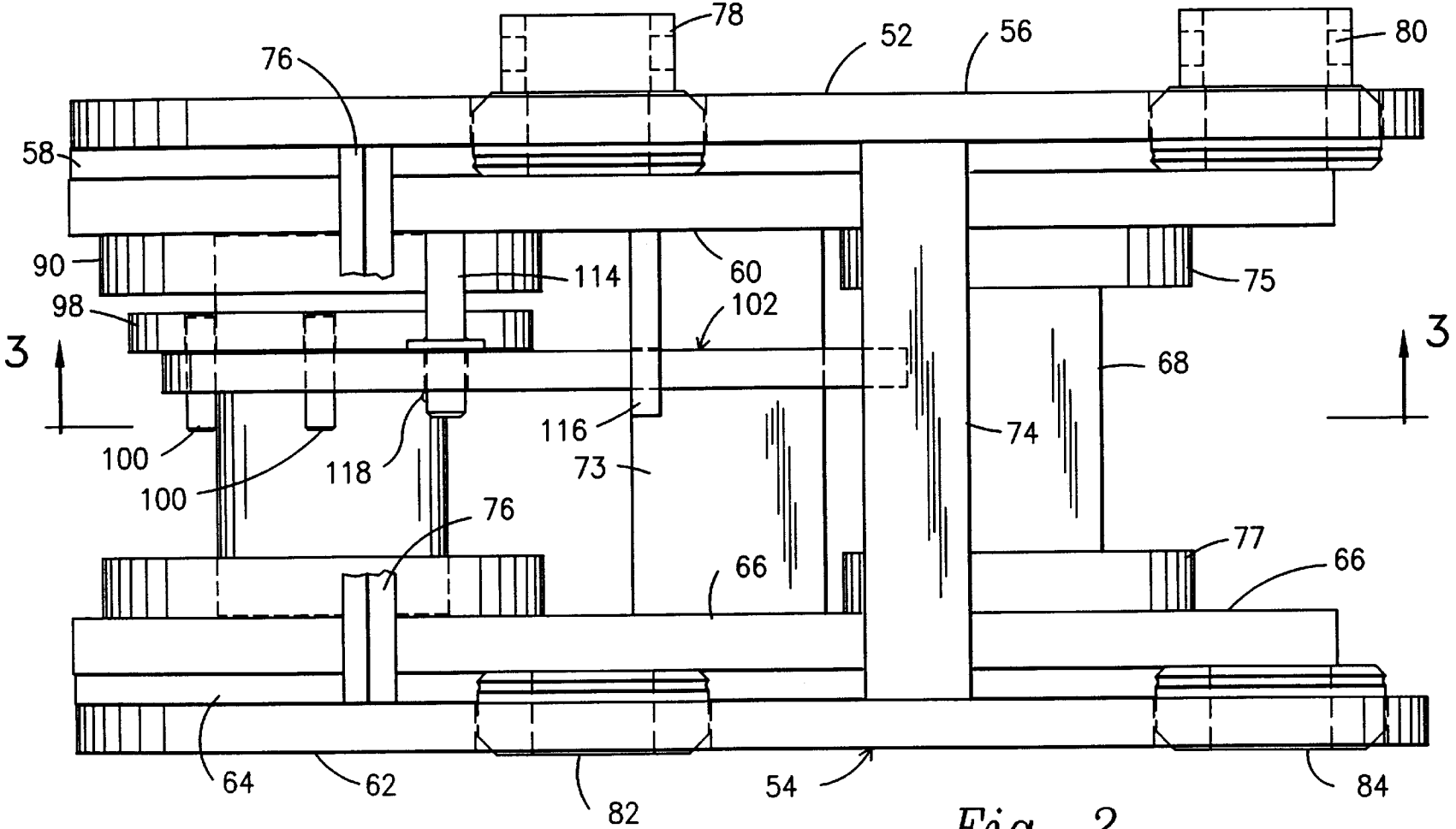
FIG. 2 is a top plan view of a first embodiment of the coupler of FIG. 1 disconnected from both the excavator and the bucket with the parts shown in the open position for receiving the bucket.
Figure 3:
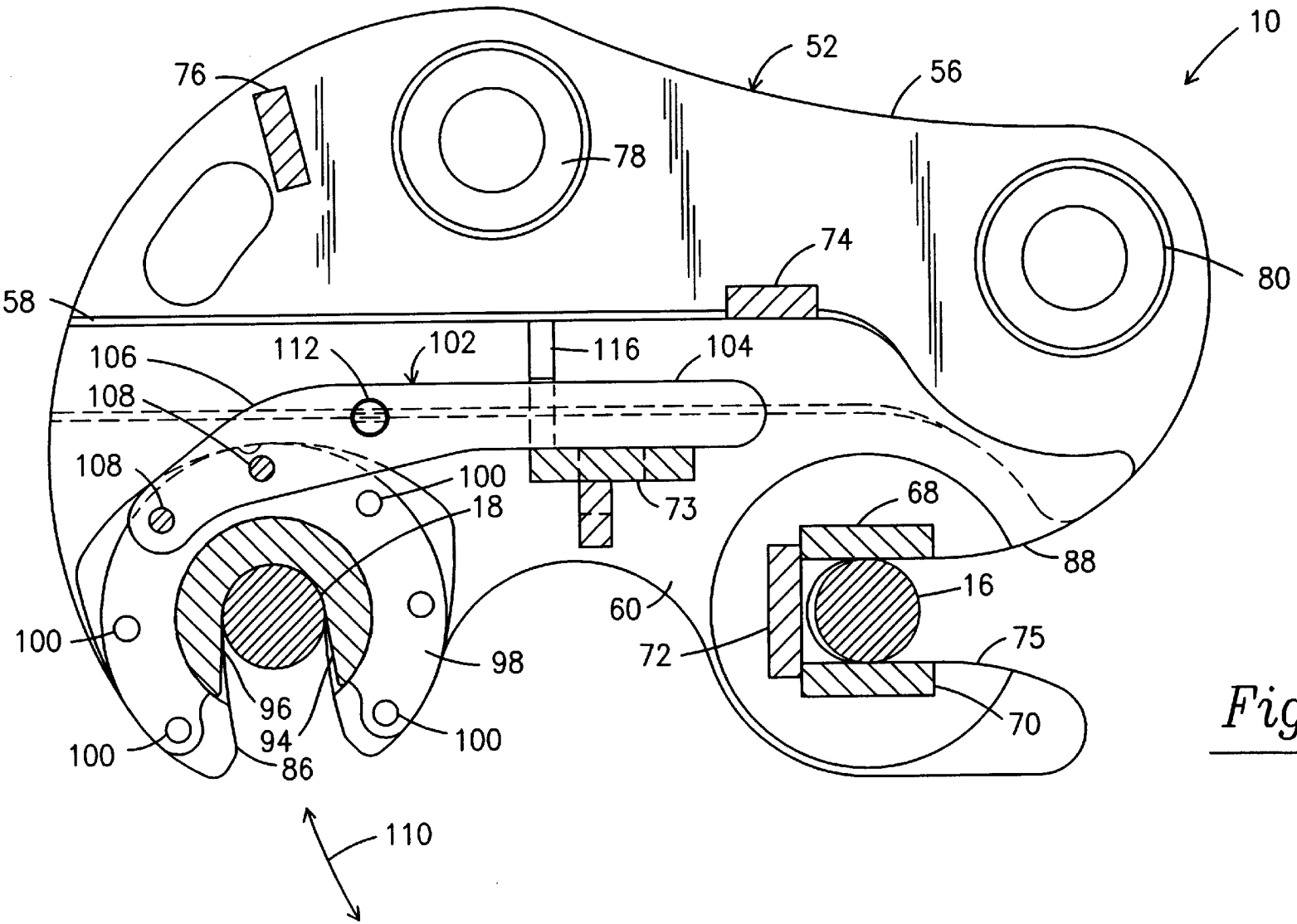
FIG. 3 is a cross sectional view of the coupler taken substantially along line 3—3 of FIG. 2.
Figure 4:
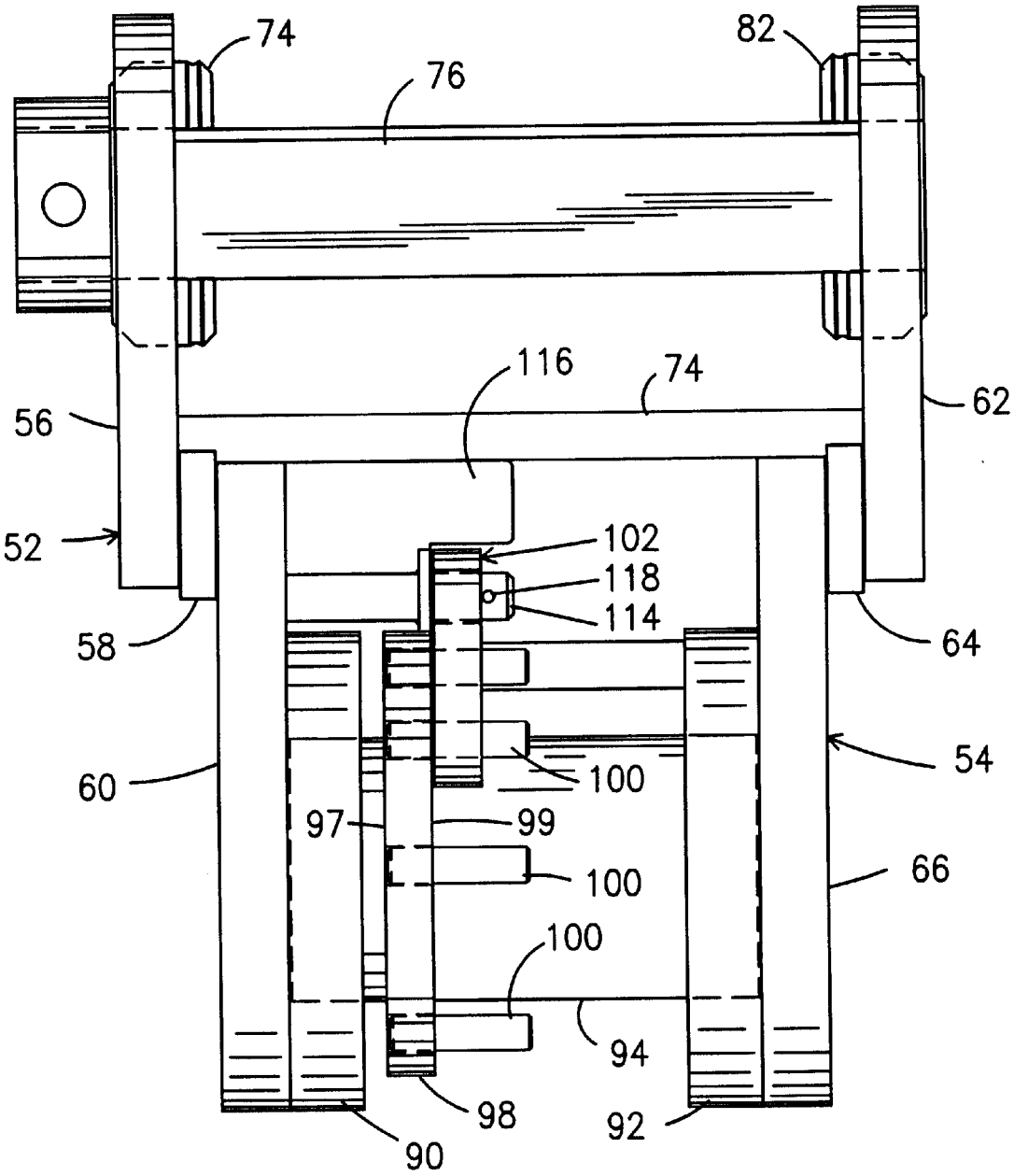
FIG. 4 is an end elevational view of the coupler as used from the left side of FIGS. 2 and 3.
Figure 5:
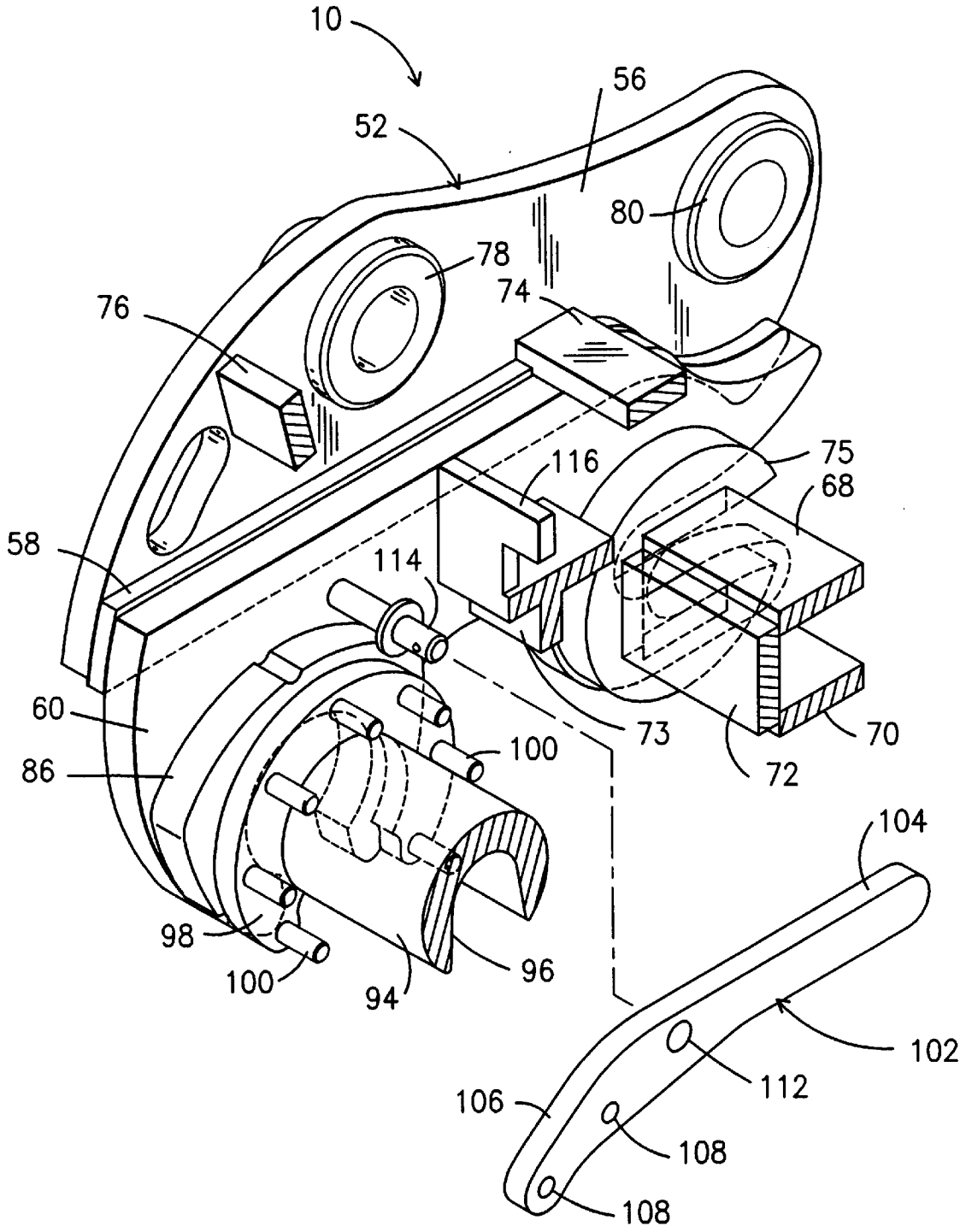
FIG. 5 is a disassembled perspective view of the coupler of the first embodiment with parts thereof removed for clarity.

As illustrated in FIGS. 2 through 4, the coupler 10 comprises a housing formed from a pair of spaced apart plates assemblies 52, 54 fabricated from a number of plate members welded together, the plate assemblies 52, 54 being connected together as hereinafter described. The plate assembly 52 comprises an upper plate 56 welded to a small plate 58 which in turn is welded to a lower plate 60, the plates 58 and 60 being disposed so as to be closer to the plate assembly 54. Similarly, the plate assembly 54 is formed from an upper plate 62, a small plate 64 disposed closer to the plate assembly 52, and a lower plate 66. Extending intermediate to plate assemblies 52, 54 is a plurality of connecting plates 68, 70, 72 and 73 which extend between plates 75, 77 welded to the interior of the lower plates 60, 66 respectively, a plate 74 and a plate 76 which extends between the upper plates 56, 62.

The upper plates 56, 62 carry respective pin mounting assemblies 78, 80 and 82, 84 respectively adopted to receive the pins 23, 25 so as to be connected to the excavator. The lower plates 60, 66 have a first set of aligned C-shaped slots 86 (only one of which is illustrated) and also have a second set of aligned C-shaped slots 88 (only one of which is illustrated). The plates 75, 77 additionally are C-shaped and thus include slots aligned with the slots 88 so that a pin, such as the pin 16 may be received into the slot and be engaged frictionally with the plates 68, 70.

Welded to the interior surfaces of the lower plate members 60, 66 is a respective C-shaped plate 90, 92, the slots in the plates being aligned with each other and with the slots 86 of the lower plate members 60, 66. The plates 90, 92 about the wall defining the slots forming bearing surfaces for receiving a rotator member 94 which spans the plates 90, 92. The rotator is a cylindrical member having a C-shaped slot 96 extending from end to end so as to form a channel, the slot or channel 96 in cross section corresponding substantially in shape to the slot 86. Welded to the outer surface of the rotator 94, preferably closer to one end than the other, is a crank 98 in the form of a substantially U-shaped or C-shaped disk having the open portion aligned at least in the central portion with that of the channel 96 so that a pin such as pin 18 may be received through the channel 96 as illustrated in FIG. 3.

Disposed about a planar surface 99 of the crank 98 are a plurality of substantially equally spaced apart pegs or studs 100 which extend in the direction toward the end of the rotator most remote from the crank 98. opposing planar surface 99 opposes planar surface 97 These pegs or studs 100 thus may be grasped to rotate the crank and thus the rotator about its axis of elongation in the bearing surfaces of the plates 90, 92. In order to grasp the studs 100, there is provided a wrench or hand tool in the form of a lever 102, the lever having an operator graspable handle 104 and a working portion 106 having at least two holes 108. The holes 108 are of a size substantially equal to or slightly larger than the diameter of the studs 100 and are spaced apart by the same amount as the spacing between the holes. Thus, the lever may be superposed over the crank with two of the studs 100 received within the holes 108. The lever may then be turned to rotate the crank a small amount. The lever may then be disengaged from the crank and reengaged with the holes receiving another combination of the studs and again be rotated. This process may be repeated until the channel 96 is disposed as desired. When the channel is aligned with the slots or openings 86 in the lower plates 60, 66, a bucket mounting pin 18 is permitted to be received in or removed from the channel. With the pin disposed therein, the crank and thus the rotator may again be turned as described until the channel 96 faces in a direction such that the pin is locked therein.

Accordingly, the bucket 12 may be fastened to the excavator by first positioning the coupler 10 with the pin 16 within the slots 88 of the plates 75, 77 and then pivoting the coupler so that the pin 18 is received within the channel 96 of the rotator 94 when it has been positioned for receipt of the pin. The rotator is then rotated to the locking position. Thus, the location of the axis of the rotator and the center of the slots 88 must be spaced apart the same amount as that of the pins 16 and 18, and the mouth or openings 86 of the lower plate 60, 66 are disposed along an arc 110 extending along a radius equal to the distance between the axes of the pins 16, 18. When the pin 18 is locked in the channel 96, the pin 16 is likewise locked in the slots 88.

When the lever 102 is not in use, it is stored within the coupler itself so that it will not be misplaced. To this end, the lever includes an additional hole 112 at a location intermediate the handle 104 and the working portion 106, and a peg 114 extends out of the plate 60 and is received within the hole 112. The lever in this stowed position receives the peg 114 within the hole 112 and two of the pegs 100 are received within the holes 108 in the lever. In this stowed position, the lower edge of the handle 104 rests on the plate 73 and there is a stop block 116 disposed above the handle so that it is locked in position. A lock pin (not illustrated) may be received through a hole 118 in the end of the peg 114 so that the lever cannot be pulled out. When the lever is to be used, the lock pin is removed from the hole 118 and the lever is pulled out of the stowed position along the pins 108 and 114 substantially parallel to the axis of rotation of the rotator 94. The lever may then be repositioned for engagement with the crank 98 and rotate the rotator.

Figure 6:
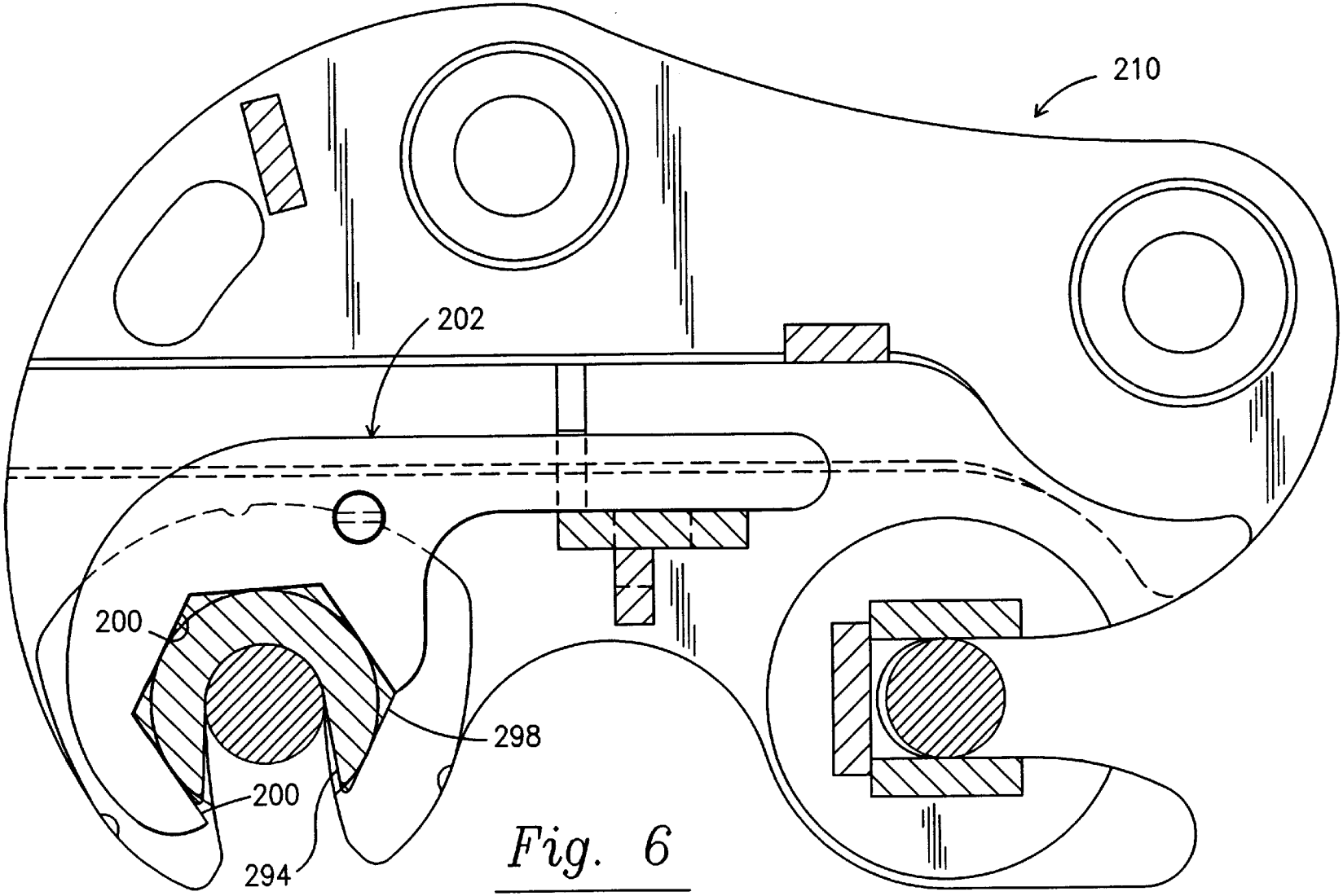
FIG. 6 is a view similar to FIG. 3, but of a second embodiment.

It should be understood that the holes 108 in the lever 102 and pegs 100 in the crank 98 may be reversed, i.e., the holes may be in the crank and the pegs in the lever without departing from the present invention. Additionally, rather than a crank with holes or pegs, the crank may have a different configuration. For example, in FIG. 6 there is illustrated another embodiment of the invention wherein the coupler 210 has a crank 298 with a periphery which is that of a hexagon or other polygon configuration with intersecting planar surfaces 200. Here, the lever 202 has a cooperating polygonical configuration for wrenching and turning the crank 298 and thus the rotator 294, the latter being identical to the rotator in the first embodiment. In all other respects the embodiment of FIG. 6 is identical to that of the embodiment of FIGS. 2–5.

Figure 7:
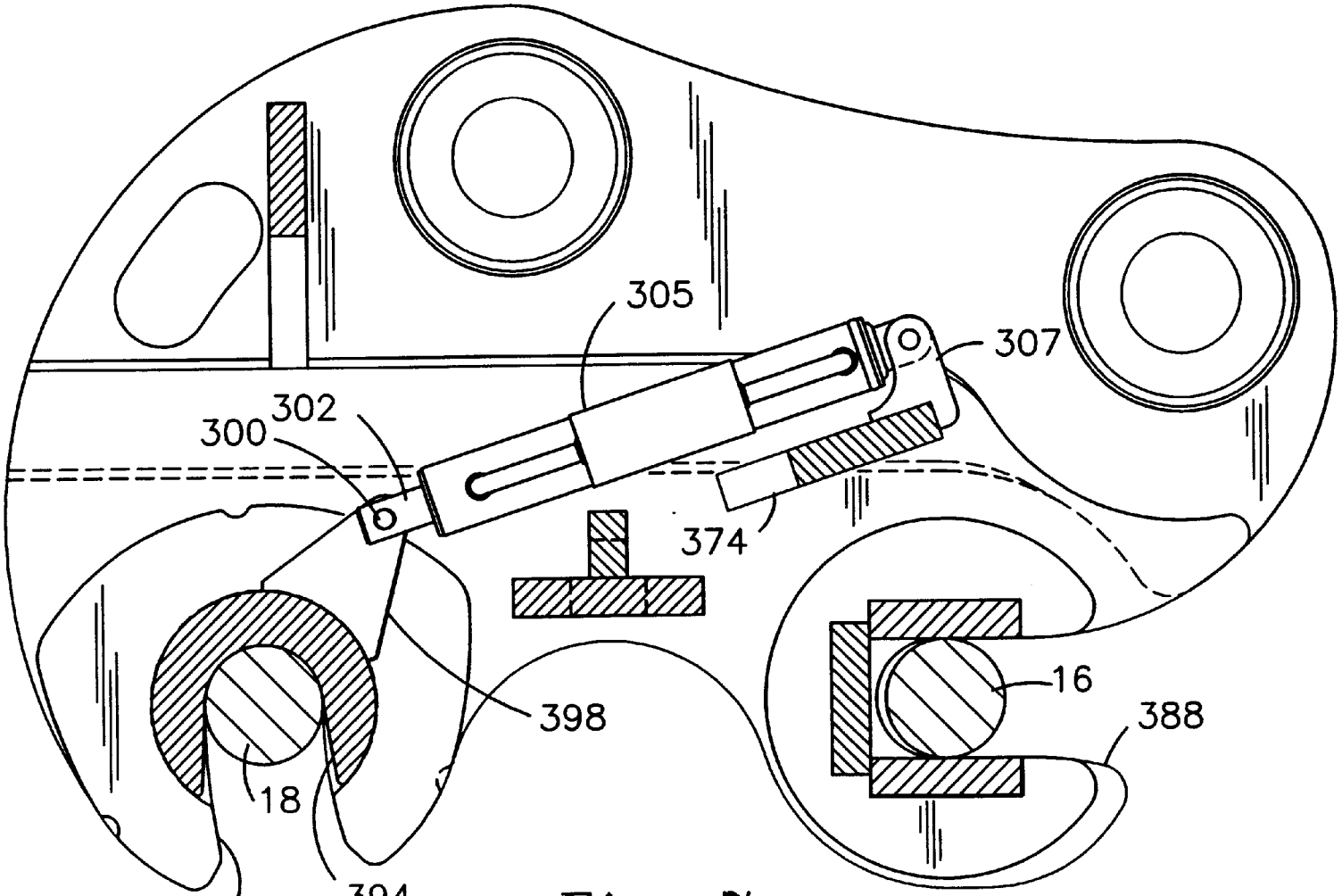
FIG. 7 is a view similar to FIG. 3, but of a third embodiment.
Figure 8:
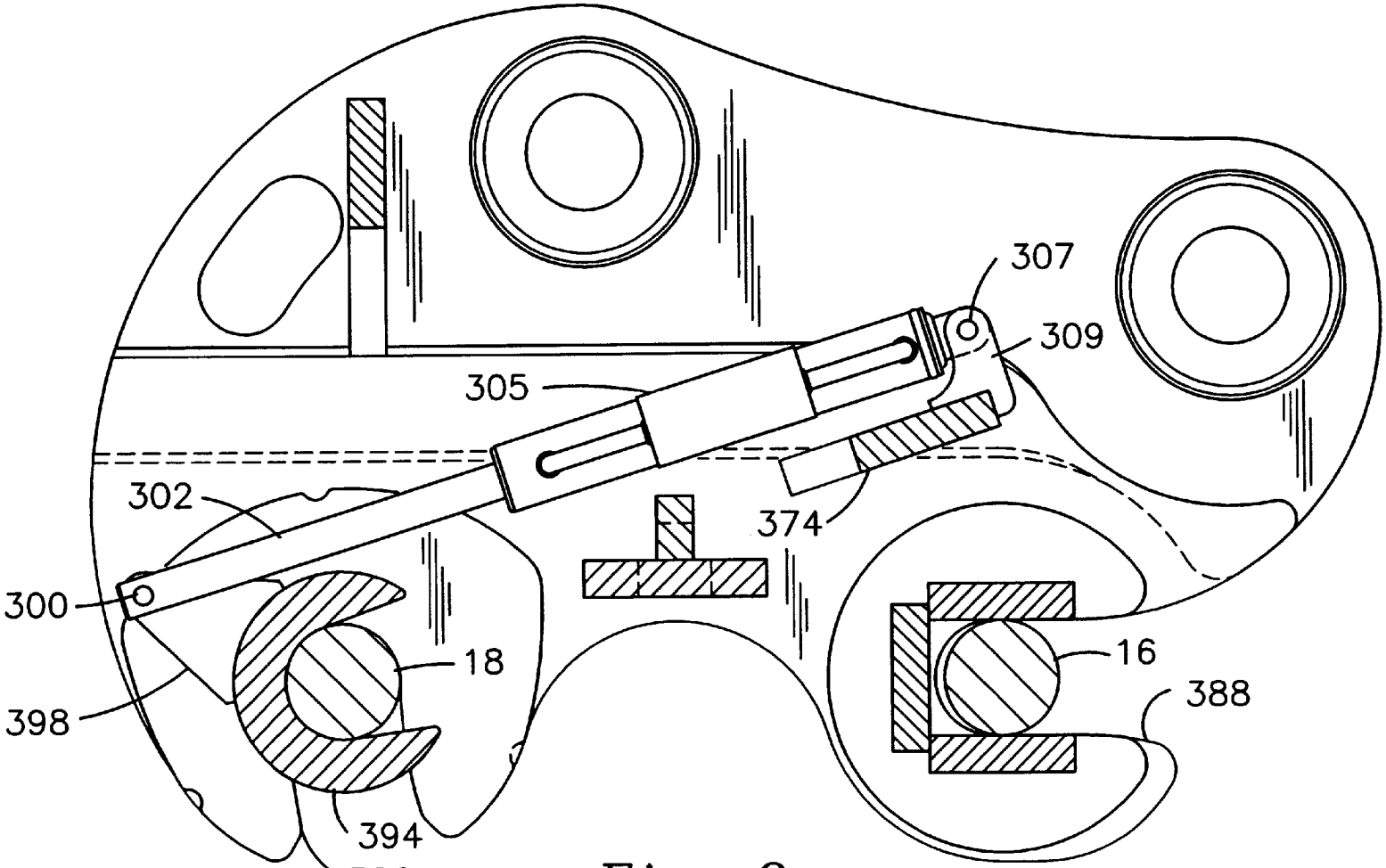
FIG. 8 is a view similar to FIG. 7 with the parts shown in the clamped position.

FIGS. 7 and 8 illustrate a still further embodiment of the invention, this being one which does not require the operator to manually turn the rotator 394. Here, the crank 398 is in the form of an ear secured to the rotator. The crank or ear 398 is connected by a pin 300 to the end of a rod 302 of a power drive member such as a hydraulic cylinder 305 having its head end connected by a pin 307 to a bracket 309 secured to and upstanding from a plate 374. A spring (not illustrated) within the cylinder 305 may act to maintain the rod 302 in the extended position, this being the position in which the pin 18 is locked within the slot 386. Thus, in the event of a failure of the hydraulic system, the bucket will remain in the coupled position.

In operation, the operator while viewing the front of the coupler, which is the right side of the coupler as illustrated in FIG. 7, may position the slot 388 to receive the pin 16. Thereafter, the operator rotates the coupler about the pin 16 as an axis until the pin 18 is within the slot 386 and thereafter actuates the hydraulic system to extend the rod 302 to rotate the rotator and lock the pin 318 within the slot 386 as illustrated in FIG. 8. When the rod is extended, the safety spring within the cylinder acts to maintain the rod extended until the cylinder is again actuated to retract the rod.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. A coupler comprising: a housing, at least one bearing mounted in said housing, a rotator supported by said bearing for rotation about an axis of rotation, said rotator including a channel configured to receive a mounting pin of a work implement, a lever having an operator graspable handle and at least one connection portion, a crank rigidly attached to the rotator having a plurality of connection sections for engaging with said at least one connection portion of said lever, said lever having a locking position wherein said crank is constrained from movement about said axis of rotation by said handle, said lever having an operative position permitting said crank to be moved radially about said axis of rotation, said coupler having an engaged position wherein said rotator is at least partly rotated about said axis of rotation permitting said pin to be within said channel and surrounded by portions of said rotator and portions of said housing, said coupler having a disengaged position wherein said rotator is positioned with said channel and said housing aligned permitting said pin to be received into said channel, and a peg connected to at least one of said housing and lever and wherein said lever engages said crank when in the locking position with said peg; said peg extending substantially parallel to said axis of rotation and said lever requiring longitudinal movement substantially parallel to said axis of rotation to transition from said locking position to said operative position to disengage said peg from at least one of said housing and lever.

2. The coupler according to claim 1 wherein said connection portion of said lever comprises an opening, and wherein at least two of said connection sections of said crank further comprise extension sections for engaging with said opening of said connection portion of said lever.

3. The coupler according to claim 1 wherein said crank further comprises at least a portion of a disk shaped member having at least two opposed planar surface portions, and one of said at least two planar surface portions has at least two extension members for engaging with said connection portion of said lever.

4. The coupler according to claim 1 further comprising a connection mechanism connected to said housing, said connection mechanism positioned to engage the lever in said locking position to mechanically restrain movement of the lever about said axis of rotation when said lever is in said locking position.

5. The coupler according to claim 4 wherein said connection mechanism comprises at least one stop block attached to said housing for mechanically constraining said lever from movement past a predetermined arc of rotation.

6. The coupler according to claim 1 further comprising a second channel located in said housing capable of receiving a second pin of a work implement.

7. The coupler according to claim 1 further comprising an attachment connection in said housing for connecting said coupler to an arm of an excavating machine.

8. The coupler according to claim 1 further comprising at least two bearings mounted in said housing and having said crank located therebetween.

9. The coupler according to claim 1 wherein said crank further comprises at least two substantially planar portions inclined one relative to another for cooperating with at least two cooperating portions of said lever to permit said lever to engage said crank to effect rotation about said axis of rotation when said lever is in said operative position.

10. An excavating machine having an articulating arm including a coupler for connecting said arm to a work implement having mounting pins, said coupler comprising: a rotator having an axis of rotation including a channel configured to receive a pin of said work implement, a lever having an operator graspable handle and at least one connection portion, a crank rigidly attached to the rotator having a plurality of connection sections for engaging with said at least one connection portion of said lever, said lever having a locking position wherein said crank is constrained from movement about said axis of rotation by said handle, said lever having an operative position permitting said crank to be moved radially about said axis of rotation, a housing, at least one bearing supported in said housing supporting said rotator for rotation about said axis of rotation relative to said housing, said coupler having an engaged position wherein said rotator is at least partly rotated about said axis of rotation with said pin within said channel such that said pin is surrounded by portions of said rotator and portions of said housing, said coupler having a disengaged position wherein said rotator is positioned with said channel and said housing aligned to allow said pin to be received into said channel, and a peg connected to at least one of said housing and lever and wherein said lever engages a crank when in a locking position with said peg; said peg extending substantially parallel to said axis of rotation and said lever requiring longitudinal movement substantially parallel to said axis for rotation to transition from said locking position to operative position to disengage said peg from at least one of said housing and lever.

11. The excavating machine as recited in claim 10, wherein said connecting portion of said lever comprises an opening, and wherein at least two of said connection sections of said crank further comprise extension sections for engaging with said opening of said connection portion of said lever.

12. The excavating machine according to claim 11 wherein said crank of said coupler further comprises at least a portion of a disk shaped member having at least two opposed planar surface portions, and one of at least two planar surface portions has at least three extension sections for engaging said opening of said connection portion of said lever.

13. The excavating machine according to claim 10 wherein said coupler further comprises a connection mechanism connected to said housing, said connection mechanism positioned to engage the lever in said locking position to mechanically restrain movement of the lever about said axis of rotation.

14. The excavating machine according to claim 10 wherein said connection mechanism of said coupler comprises at least one stop block attached to said housing which mechanically constrains said lever from movement past a predetermined are of rotation.

15. The excavating machine according to claim 10 wherein said coupler further comprises a second channel located in said housing capable of receiving a second pin of a work implement.

16. The excavating machine according to claim 10 wherein said coupler further comprises an attachment connection in said housing for connecting said coupler to an arm of an excavating machine.

17. The excavating machine according to claim 10 wherein said coupler further comprises at least two bearings mounted in said housing and having said crank located therebetween.

* * * * *